United States Patent [19]

Nast

[11] Patent Number: 5,056,177

[45] Date of Patent: Oct. 15, 1991

[54] CLEANOUT APPARATUS

[76] Inventor: Irving J. Nast, 217 N. Kenwood St., Glendale, Calif. 91206

[21] Appl. No.: 387,628

[22] Filed: Jul. 31, 1989

[51] Int. Cl.[5] ..... B08B 9/04

[52] U.S. Cl. ..... 15/104.33; 15/104.31; 4/257

[58] Field of Search ..... 15/104.31, 104.32, 104.33; 4/253, 257, 256, 255, DIG. 7; 248/205.1, 274, 279, 309.1, 316.1, 316.4; 269/51, 87.2, 97, 100

[56] References Cited

U.S. PATENT DOCUMENTS

| | | | |
|---|---|---|---|
| 271,257 | 1/1883 | Pike | 4/257 |
| 1,539,718 | 5/1925 | Crum | 15/56 |
| 1,817,015 | 8/1931 | Miller | 15/104.33 |
| 4,502,167 | 3/1985 | Porzelius | 4/253 |

*Primary Examiner*—Harvey C. Hornsby
*Assistant Examiner*—Gary K. Graham
*Attorney, Agent, or Firm*—James E. Brunton

[57] ABSTRACT

An apparatus for use in combination with either hand or power driven sewer cleanout tools of the character having an elongated coil spring. The apparatus is secured to the top of a toilet bowl in a manner to safely permit the coil spring, or snake, to be controllably fed into a clogged toilet drain of toilets of widely varying configuration.

10 Claims, 3 Drawing Sheets

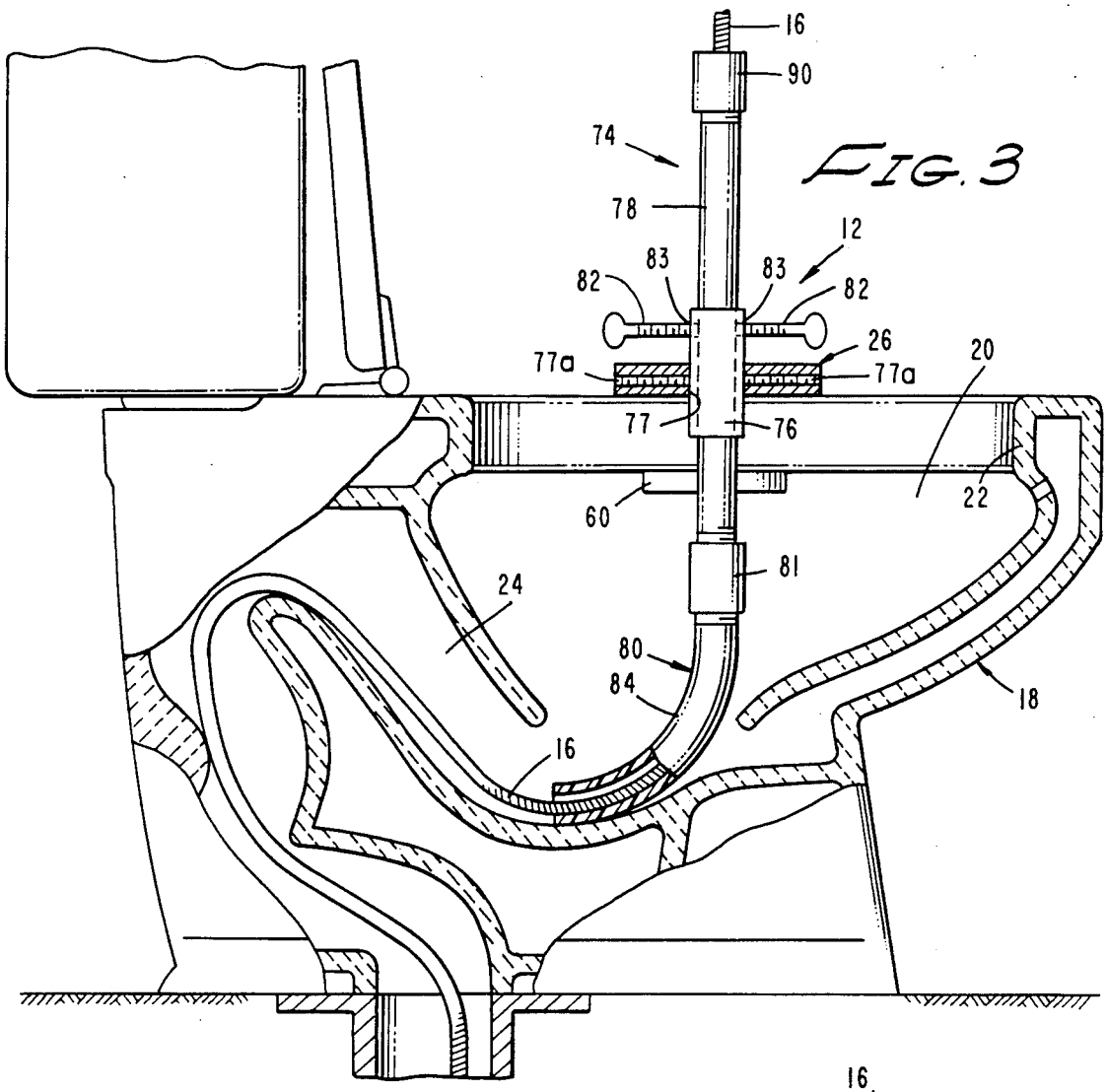
FIG. 3
FIG. 7
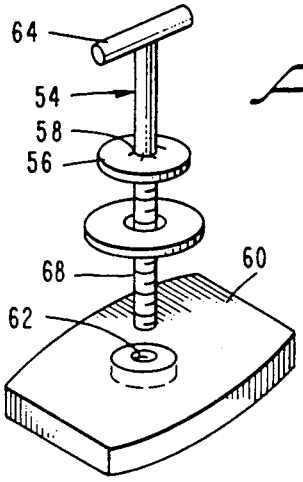
FIG. 11
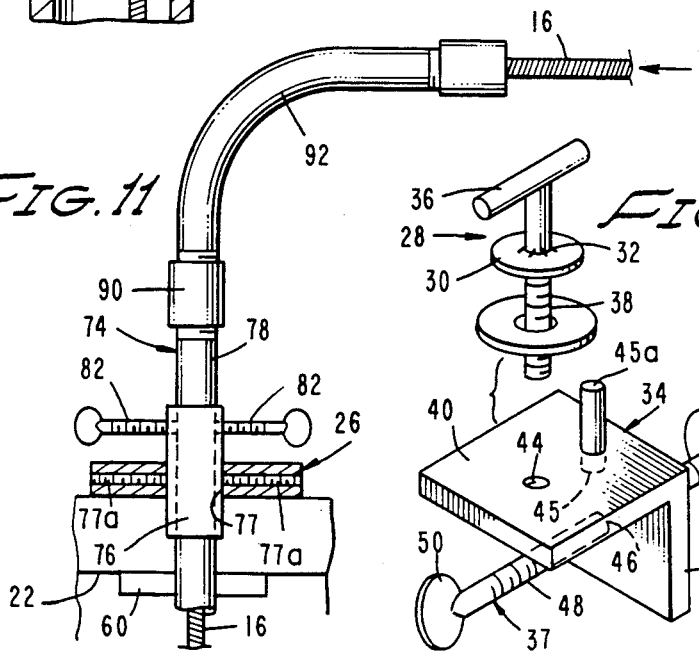
FIG. 8
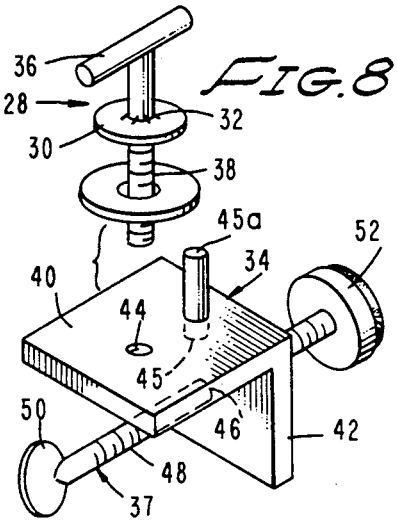

FIG. 4
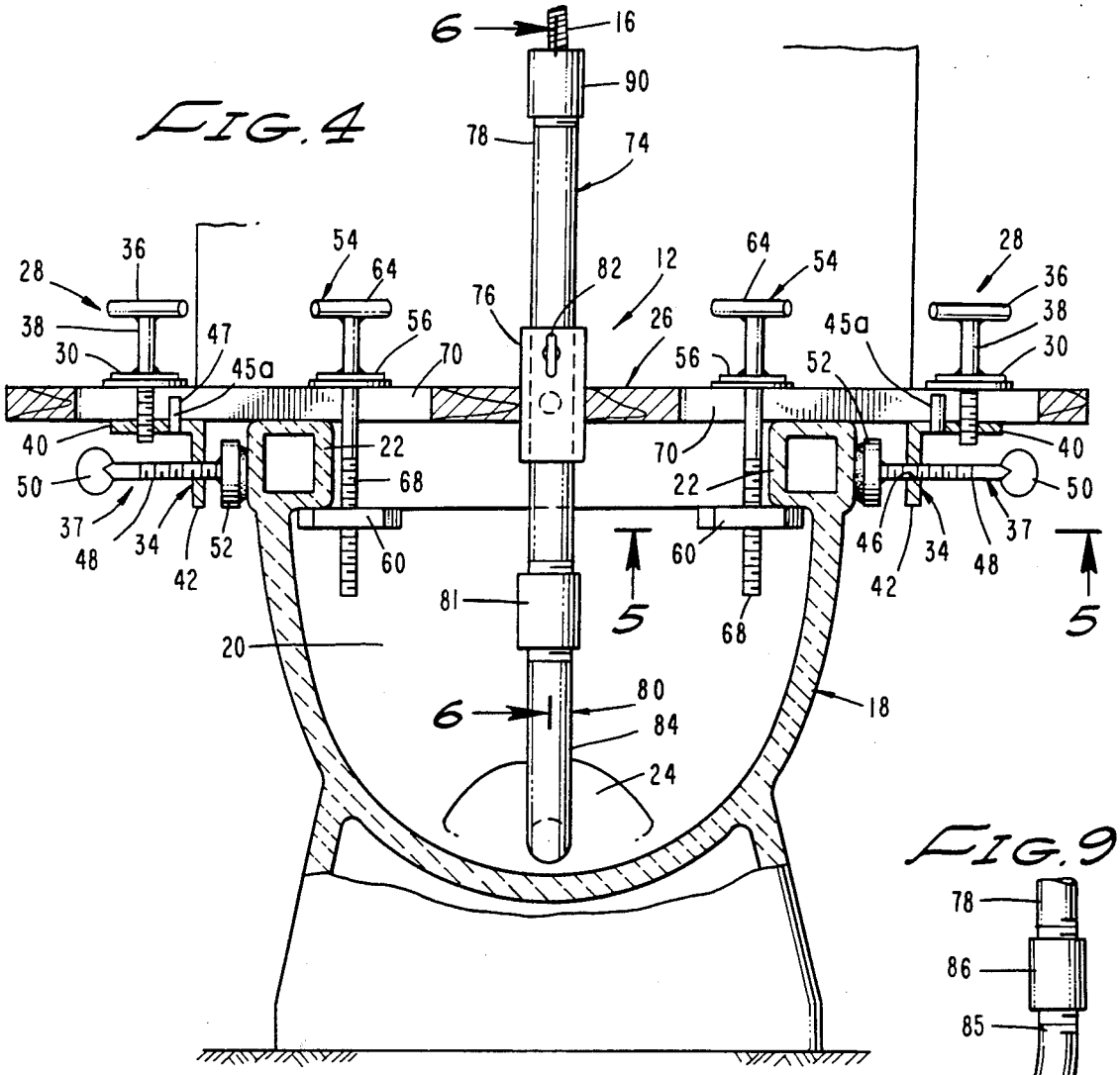
FIG. 9
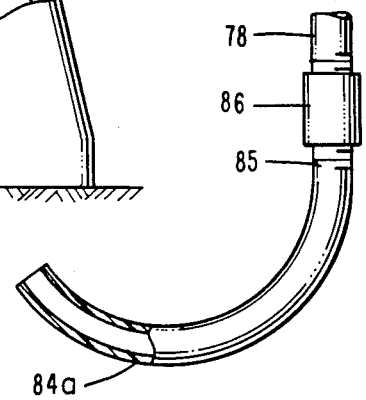
FIG. 5
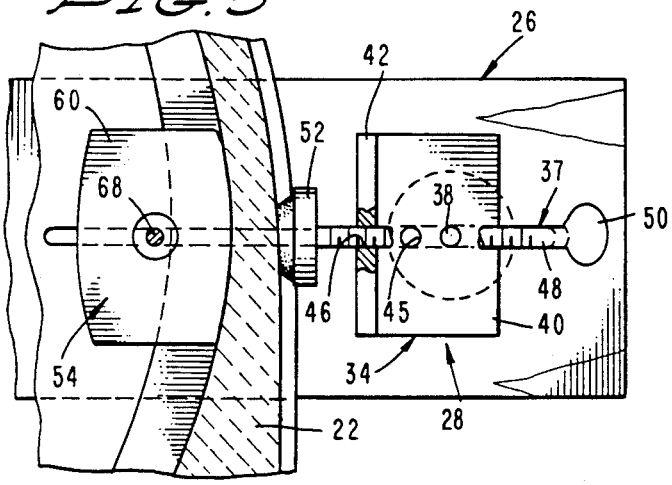
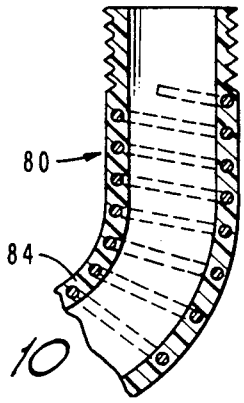
FIG. 10

CLEANOUT APPARATUS

BACKGROUND OF THE INVENTION

1. Field of The Invention

The present invention generally relates to sewer cleanout tools. More particularly, the invention concerns an apparatus which enables hand or power driven sewer cleanout tools of the character embodying a long length of coil spring, or plumber's snake, to be used in clearing stoppages in toilets of widely varying configuration.

2. Discussion of The Invention

Because of the tortuous drain configuration of the standard toilet, devices called "closet augers" are generally used for clearing stoppages in toilets. The typical prior art closet auger consists of a tubular barrel or casing about three feet in length, a flexible plumber's snake of about the same length and a handle also about three feet in length to which the end of the snake is affixed. In operating the device, the snake is withdrawn into the tube so that the handle extends upwardly about three feet from the end of the tube. The end of the snake is then inserted into the toilet, or water closet, and the handle is telescoped into the tube with a rotating action forcing the three foot length of snake downwardly into the water closet piping. Since at the beginning of the cleanout operation the handle is more than six feet above floor level, operation of the device is quite cumbersome.

The length of the snake in the typical closet auger being quite short, makes it impossible to clear stoppages located further down the sewer drain line. To clear such stoppages, the sewer line must be accessed from a different location, or, alternatively, the toilet must be removed so that the line can be accessed by a standard hand or power operated sewer cleanout tool. Frequently, it is very difficult to gain access to the main sewer line or to gain access at a point where the stoppage in a branch line of the drain system can be cleared. This is especially true in multistory structures and where there may be numerous offsets in the line where a stoppage can exist.

The apparatus of the present invention advantageously permits the use of the standard prior art sewer cleanout tool to readily access the main line without having to remove the toilet. Accordingly, blockages in the sewer line located great distances from the toilet can expeditiously be cleared.

Further, use of the present apparatus, with standard sewer cleanout tools to clear toilet blockages is considerably easier and much more efficient than using closet augers of the character described in the preceding paragraphs.

SUMMARY OF THE INVENTION

It is an object of the present invention to provide an apparatus which can be used in conjunction with a standard hand or power driven sewer cleanout tool embodying a long length of coil spring to clear blockages in toilets of widely varying sizes and shapes and to clear blockages in sewer lines at locations remote from the toilet.

It is another object of the invention to provide an apparatus of the aforementioned character which can be used with sewer cleanout tools of standard construction to access a main sewer line via a toilet without having to remove the toilet from its floor mounting.

More particularly, through use of the apparatus of the invention, long lengths of coil springs, or snakes, can be inserted into a drain system with relative ease even when a main line cleanout plug cannot be located or easily accessed.

Another object of the invention is to provide an apparatus of the character described which does not require the use of special tools or training and one which can be operated efficiently by unskilled persons.

Still another object of the invention is to provide an apparatus as described in the previous paragraphs which is of simple construction, but yet is readily adjustable to permit its use with toilets having varying internal and external configurations.

BRIEF DESCRIPTION OF THE DRAWINGS

FIG. 3 is a cross sectional view of the apparatus taken along lines 3—3 of FIG. 2.

FIG. 4 is a front view partly broken away to illustrate the positioning of the apparatus of the invention on the toilet.

FIG. 5 is a cross sectional view taken along lines 5—5 of FIG. 4.

FIG. 7 is a generally perspective view illustrating the configuration of one of the clamping assemblies of the apparatus of the invention.

FIG. 8 is a generally perspective view illustrating the configuration of one of the other side clamping assemblies of the invention.

FIG. 9 is a fragmentary view, partly in cross section, illustrating an alternate form of the lower portion of the guide tube of the invention.

FIG. 10 is an enlarged fragmentary view illustrating the construction of the curved guide tube portion of the apparatus of the invention.

FIG. 11 is a fragmentary view of an alternate form of the upper guide tube assembly of the invention.

DESCRIPTION OF THE INVENTION

Figure 1:
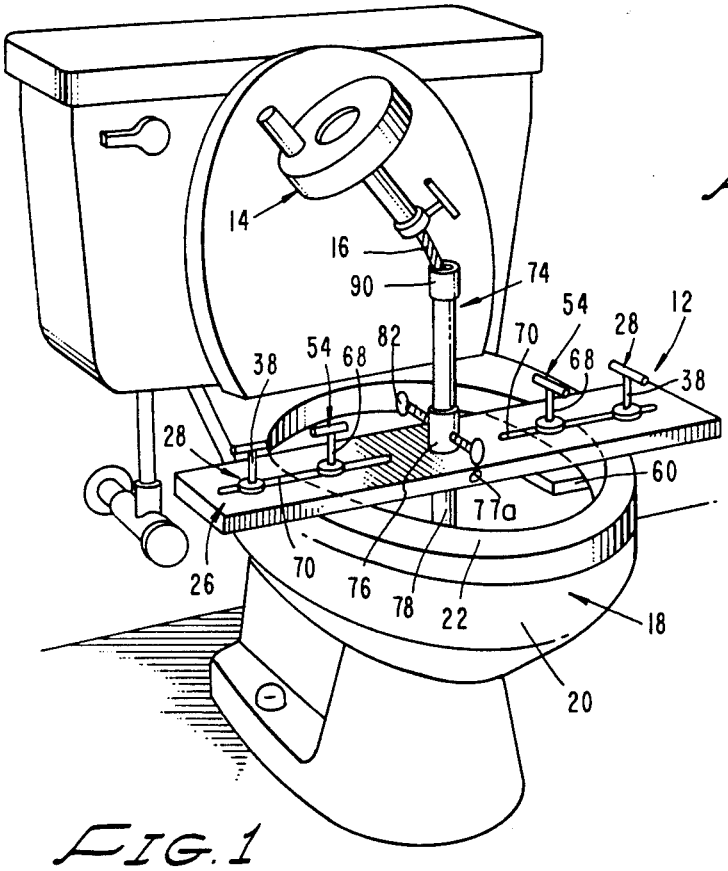
FIG. 1 is a generally perspective view of the apparatus of the invention mounted in a cleanout position on a toilet.

Referring to the drawings, and particularly to FIGS. 1 through 4, the apparatus of the present invention, generally designated by the numeral 12, is shown in use in combination with a sewer cleanout tool 14 of the character having an elongated coil spring 16. In a manner presently to be described, the apparatus of the invention enables the coil spring 16 of the sewer cleanout tool to be controllably fed into a clogged toilet drain of a toilet 18 of conventional construction having a top open bowl 20 provided with an upper circumferentially extending rim 22 and including a tortuous internal drain 24.

The apparatus of the embodiment of the invention shown in the drawings comprises a base 26 which spans the toilet bowl, first clamping means adjustably connected to the base for exerting an inward pressure on the outside of the rim 22 of the toilet bowl, second clamping means adjustably connected to the base for engagement with the underside of rim 22 to prevent upward movement of the base relative to the rim 22, and centrally disposed coil spring guide means for receiving and guiding the plumber's snake into the internal drain 24 of the toilet.

As best seen by referring to FIG. 4, the first clamping means of the invention comprises a pair of transversely spaced clamping assemblies generally designated by the numeral 28. Referring also to FIG. 8, assemblies 28 can be seen to comprise a plate-like element 30 having a central aperture 32 therethrough, an angle support member 34, a first clamping member 36 and a second clamping member 37. First clamping member 36 is generally "T" shaped and includes a shank portion 38 which extends through aperture 32 of plate 30. Plate 30 is affixed proximate the upper end of clamping member 36 by any suitable means such as welding. Angle member 34 comprises first and second perpendicularly extending legs 40 and 42. Leg 40 is provided an internally threaded aperture 44, and an alignment plug receiving aperture 45 while leg 42 is provided with an internally threaded aperture 46. As best seen in FIG. 8, second clamping member 37 includes a threaded shank portion 48 which is threadably receivable within aperture 46. Provided at one end of clamping member 37 is a gripping member 50 for imparting rotational movement to the clamping member. Provided at the opposite end of clamping member 37 is a rim engaging member 52 which is rotatably connected to clamping member 37 for rotation about the longitudinal axis thereof. An alignment plug 45*a* is receivable within aperture 45 and an aligned aperture 47 provided in base 26 (FIG. 4).

The second clamping means of the apparatus of the present form of the invention comprises a pair of identically configured, transversely spaced apart second clamping assemblies 54 (FIG. 4). As best seen by referring to FIG. 7, each of these second clamping assemblies 54 comprises a plate-like member 56 having a central aperture 58, a lower rim engaging member 60 provided with an internally threaded aperture 62 and a generally "T" shaped clamping member 64. Clamping member 64 has a threaded shank portion 68 which is receivable through aperture 58 of plate 56. Plate 56 is suitably affixed to shank portion 68 proximate the upper end thereof by any suitable means such as welding.

An important feature of the apparatus of the present invention resides in the fact that base 26 is provided with a pair of transversely spaced apart, longitudinally extending slots 70 which are adapted to slidably receive the first and second clamping means of the apparatus of the invention. More particularly, as can best seen in FIGS. 1 and 4, the shank portions 38 and 68 of the first and second clamping assemblies are closely received within slots 70 and are adjustably movable toward and away from the coil spring guide means of the invention which is mounted centrally of base 26. This important adjustability feature of the apparatus permits it to be conveniently used with toilets of varying designs and configurations having bowls of different diameters and having upper rims of widely differing configuration.

Figure 6:
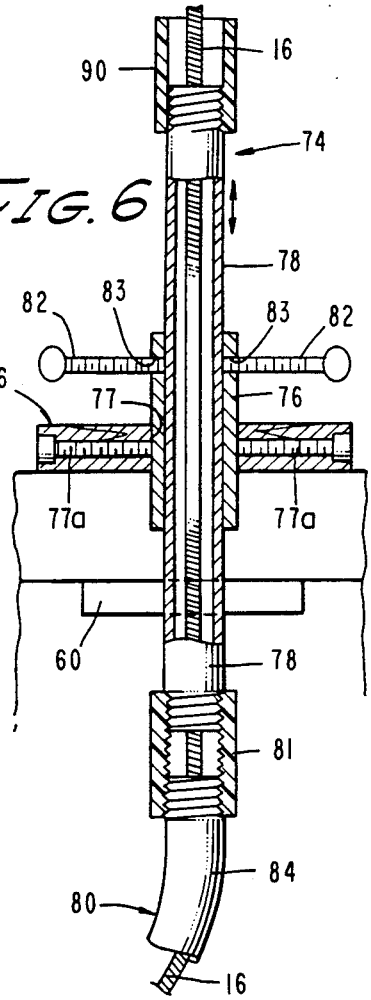
FIG. 6 is a fragmentary, cross sectional view of the apparatus taken along lines 6—6 of FIG. 4, illustrating the manner of vertical adjustment of the guide tube thereof.
Figure 2:
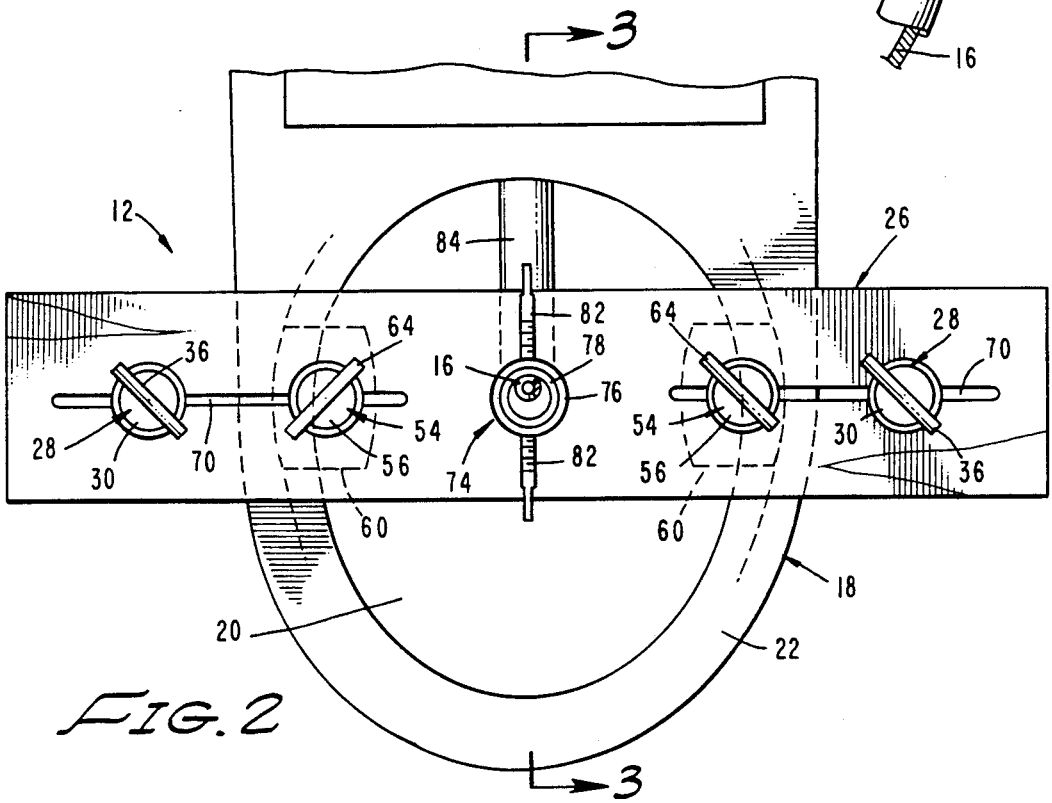
FIG. 2 is a top plan view of the apparatus of the invention as seen mounted on a toilet in a cleanout position.

Referring now particularly to FIGS. 3 and 6, the coil spring guide means of the apparatus of the present invention comprises a spring guide assembly 74 which includes a sleeve 76 which is secured within a central aperture 77 formed within base 26 by means of a pair of transversely extending set screws 77*a* (FIG. 6). The spring guide means also comprises an upper guide tube 78 which is telescopically receivable within sleeve 76 and a curved lower guide tube assembly 80 which is connected to lower guide tube 78 by means of a coupler 81. Sleeve 76 is provided with oppositely disposed threaded apertures 83 for threadably receiving a pair of thumb screws 82. As indicated in FIG. 6, the inner ends of thumb screws 82 are adapted to pressurally engage sleeve 78 and lock it against telescopic movement within sleeve 76. Upon loosening thumb screws 82, sleeve 76 can be telescopically moved upwardly or downwardly relative to sleeve 76 so as to position the lower guide tube assembly 80 in an optimum position with respect to drain opening 24 of the particular toilet being cleaned.

Lower guide tube assembly 80 comprises a curved guide tube 84 which is configured to guide the plumber's snake 16 downwardly through the guide tube assembly and then smoothly into drain opening 24. The lower end of guide tube 78 is threaded for connection with coupler member 81 in the manner shown in the drawings. Lower curved tube 84 is also threaded proximate its upper end for connection with coupler 81. In this way, upper tube 78 can be operably coupled with curved lower tube 84 so as to provide a smooth continuous guide path for the plumber's snake 16.

Referring to FIG. 9, an alternate form of curved lower guide tube 84*a* is thereshown. Guide tube 84*a* is of similar construction to guide tube 84 having a threaded end 85 for threadable connection with coupler 86. As indicated in the drawings, curved tube 84*a* is longer than curved tube 84 and permits the device to be more conveniently used in connection with toilets wherein the drain 24 is of a different more sharply curved configuration.

Provided proximate the upper threaded end of tubular guide 78 is a second coupling 90 which is used to interconnect the apparatus of the invention with an upper curved tubular member 92 (FIG. 11) which can be used when it is desirable to insert the plumber's snake in a horizontal direction rather than a vertical direction.

In using the apparatus of the invention, base 26 is positioned on top of the toilet rim 22 with the spring guide assembly 74 generally centered with respect to the top opening in the toilet. Next, thumb screws 82 are loosened so that the appropriated curved guide tube 84 or 84*a* can be positioned with respect to the toilet drain 24 in the manner shown in FIGS. 3 and 4. This done, thumb screws 82 are tightened against guide tube 78 and clamping assemblies 28 are slid inwardly within slots 70 to bring rim engaging members 52 into engagement with the outer surfaces of rim 22 in the manner shown in FIG. 4. By then first tightening the "T" shaped clamping members 36 and then the clamping members 37, the base can be securely locked against transverse movement relative to the toilet rim 22. With the base thus locked in position, clamping assemblies 54 are moved within slots 70 until the lower rim engaging members 60 are positioned beneath rim 22 in the manner shown in FIG. 2. Tightening of "T" shaped clamping members 64 will then lock the base against vertical movement relative to rim 22.

With base 26 thusly locked securely in position on the toilet, snake 16 of the sewer cleanout tool 14 can be inserted into the top of guide tube 78 and progressively, rotatably fed into the guide tube assembly and thence into toilet drain 24 in a safe and convenient manner.

If it is more desirable for the particular cleanout job at hand to feed the snake 16 horizontally into the guide tube assembly rather than vertically, upper guide tube 92 can be connected to coupler 90 in the manner illustrated in FIG. 11.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention as set forth in the following claims.

I claim:

1. An apparatus for use in cleaning out a clogged toilet of the type having a top open bowl provided with a circumferentially extending rim and a curved internal drain, said apparatus being usable with a sewer cleanout tool of the character having an elongated coil spring which is controllably fed into the toilet drain and rotated about its longitudinal axis, said apparatus comprising:

(a) an elongated base having a length sufficient to span the opening in the toilet;

(b) means carried by said base for engagement with the rim of the toilet bowl to prevent movement of said base relative to the rim of the toilet, said means comprising first and second clamping means affixed to said base, said first clamping means exerting an inward pressure on the outside of said rim portion of said bowl and said second clamping means exerting a pressure on said rim portion of said bowl to secure said base against upward movement, said first clamping means comprising a pair of clamping assemblies each including a support member, means for connecting said support member to said base and rim engaging means connected to said support member for movement relative thereto to exert an inward pressure on the outside of said rim portion of said bowl; and (c) coil spring guide means centrally carried by said base for telescopically receiving the elongated coil spring of the plumber's tool and guiding it into the curved internal drain of the toilet.

2. An apparatus as defined in claim 1 in which said base has first and second end portions and a central portion and is provided with at least one longitudinally extending slot within which said first clamping means and said second clamping means are carried for sliding movement toward and away from said central portion.

3. An apparatus as defined in claim 2 in which said coil spring guide means comprises a coil spring guide assembly including:

(a) a sleeve affixed to said base proximate the central portion thereof;

(b) an upper guide tube telescopically receivable within said sleeve; and (c) a curved lower guide tube operably associated with said upper guide tube.

4. An apparatus as defined in claim 3 further including locking means carried by said sleeve for preventing telescopic movement of said upper guide tube relative to said sleeve.

5. An apparatus for use in combination with a sewer cleanout tool of the character having an elongated coil spring which can be controllably fed into a clogged toilet drain of a toilet having a top open bowl with an upper circumferentially extending rim and a curved, internal drain, said apparatus comprising:

(a) a base having a central portion, first and second ends and being of a length sufficient to span the opening in a toilet bowl;

(b) first clamping means affixed to said base at locations proximate said first and second ends thereof for exerting an inward pressure on the outside of said rim portion of said toilet bowl, said first clamping means comprising a pair of clamping assemblies, each said clamping assembly including;

(i) a top plate having an aperture therethrough;

(ii) an angle member having first and second perpendicularly extending legs, each said leg having a threaded aperture therethrough;

(iii) a first clamping member having a handle and a threaded shank threadably receivable within said threaded aperture of said first leg of said angle member; and (iv) a second clamping member having a gripping member, a threaded shank threadably receivable within said threaded aperture of said second leg of said angle member and a rim engaging member rotatably connected to said threaded shank;

(c) second clamping means affixed to said base at locations intermediate said first end and said central portion and intermediate said second end and said central portion for engagement with said rim of said toilet bowl to secure said base against upward movement relative to the top of said rim portion;

(d) a guide tube assembly carried by said base proximate said central portion thereof, said guide tube assembly comprising:

(i) a sleeve connected to said base portion proximate the central portion thereof;

(ii) an upper guide tube telescopically receivable within said sleeve for vertical movement therewithin;

(iii) a curved lower guide tube connected to said upper guide tube; and (iv) locking means carried by said sleeve for releasably locking said upper guide tube against vertical movement.

6. An apparatus as defined in claim 5 in which said second clamping means comprises a pair of clamping assemblies, each said clamping assembly including;

(a) a top plate having an aperture therethrough;

(b) a lower rim engaging member having a threaded aperture therethrough; and (c) a clamping member having a gripping member and a threaded shank, said threaded shank being threadably receivable within said threaded aperture of said lower rim engaging member.

7. An apparatus for use in combination with a sewer cleanout tool of the character having an elongated coil spring which can be controllably fed into a clogged toilet drain of a toilet having a top open bowl with an upper circumferentially extending rim and a curved, internal drain, said apparatus comprising:

(a) a base having a central portion, first and second ends and being of a length sufficient to span the opening in a toilet bowl;

(b) first clamping means affixed to said base at locations proximate said first and second ends thereof for exerting an inward pressure on the outside of said rim portion of said toilet bowl, said first clamping means comprising a pair of clamping assemblies, each including:

(i) a top plate having an aperture therethrough;

(ii) an angle member having first and second perpendicularly extending legs, each said leg having a threaded aperture therethrough;

(iii) a first clamping member having a handle and a threaded shank threadably receivable within said threaded aperture of said first leg of said angle member; and (iv) a second clamping member having a gripping member, a threaded shank threadably receivable within said threaded aperture of said second leg of said angle member and a rim engaging member rotatably connected to said threaded shank;

(c) second clamping means affixed to said base at locations intermediate said first end and said central portion and intermediate said second end and said central portion for engagement with said rim of said toilet bowl to secure said base against upward movement relative to the top of said rim portion, said second clamping means comprising a pair of clamping assemblies, each including:

(i) a top plate having an aperture therethrough;

(ii) a lower rim engaging member having a threaded aperture therethrough;

(iii) a clamping member having a gripping member and a threaded shank, said threaded shank being threadably receivable within said threaded aperture of said lower rim engaging member; and (d) a guide tube assembly carried by said base proximate said central portion thereof, said guide tube assembly comprising:

(i) a sleeve connected to said base portion proximate the central portion thereof;

(ii) an upper guide tube telescopically receivable within said sleeve for vertical movement therewithin;

(iii) a curved lower guide tube connected to said upper guide tube; and (iv) locking means carried by said sleeve for releasably locking said upper guide tube against vertical movement.

8. An apparatus for use in cleaning out a clogged toilet of the type having a top open bowl provided with a circumferentially extending rim and a curved internal drain, said apparatus being usable with a sewer cleanout tool of the character having an elongated coil spring which is controllably fed into the toilet drain and rotated about its longitudinal axis, said apparatus comprising:

(a) an elongated base having a length sufficient to span the opening in the toilet, said base having a central portion and a longitudinally extending slot;

(b) means carried by said base for engagement with the rim of the toilet bowl to prevent movement of said base relative to the rim of the toilet, said means comprising first and second clamping means adjustably connected to said base, said first clamping means exerting an inward pressure on the outside of said rim portion of said bowl and said second clamping means exerting a pressure on said rim portion of said bowl to secure said base against upward movement, said first clamping means comprising a pair of clamping assemblies each including a support member, means for connecting said support member to said base for sliding movement thereof relative to said slot and rim engaging means threadably carried by said support member for movement relative thereto to exert an inward pressure on the outside of said rim portion of said bowl; and (c) coil spring guide means centrally carried by said base for telescopically receiving the elongated coiled spring of the plumber's tool and guiding it into the curved internal drain of the toilet.

9. An apparatus as defined in claim 8 in which said coil spring guide means comprises a coil spring guide assembly including:

(a) a sleeve affixed to said base proximate the central portion thereof;

(b) an upper guide tube telescopically receivable within said sleeve; and (c) a curved lower guide tube operably associated with said upper guide tube.

10. An apparatus as defined in claim 9 further including locking means carried by said sleeve for preventing telescopic movement of said upper guide tube relative to said sleeve.

* * * * *